US011826714B2

(12) United States Patent
Shimazu

(10) Patent No.: US 11,826,714 B2
(45) Date of Patent: Nov. 28, 2023

(54) FINE BUBBLE GENERATOR

(71) Applicant: RINNAI CORPORATION, Nagoya (JP)

(72) Inventor: Tomoyuki Shimazu, Nagoya (JP)

(73) Assignee: RINNAI CORPORATION, Nagoya (JP)

( * ) Notice: Subject to any disclaimer, the term of this patent is extended or adjusted under 35 U.S.C. 154(b) by 0 days.

(21) Appl. No.: 17/805,238

(22) Filed: Jun. 3, 2022

(65) Prior Publication Data

US 2023/0009590 A1 Jan. 12, 2023

(30) Foreign Application Priority Data

Jun. 4, 2021 (JP) ..... 2021-094355

(51) Int. Cl.

| | |
|---|---|
| ***B01F 23/23*** | (2022.01) |
| ***B01F 23/231*** | (2022.01) |
| ***B01F 25/312*** | (2022.01) |
| ***B01F 23/232*** | (2022.01) |

(52) U.S. Cl.

CPC .. *B01F 23/23113* (2022.01); *B01F 23/23231* (2022.01); *B01F 25/312512* (2022.01)

(58) Field of Classification Search

CPC ..... B01F 23/23113; B01F 23/23231; B01F 25/312512

See application file for complete search history.

(56) References Cited

U.S. PATENT DOCUMENTS

| | | | | |
|---|---|---|---|---|
| 4,370,304 | A | 1/1983 | Hendriks et al. | |
| 6,969,052 | B2 | 11/2005 | Korzeniowski | |
| 10,695,726 | B2 * | 6/2020 | Tian | B01F 27/55 |
| 11,077,411 | B2 | 8/2021 | Shibata et al. | |
| 2007/0205523 | A1 | 9/2007 | Kojima | |
| 2017/0304782 | A1 | 10/2017 | Wu | |
| 2018/0023600 | A1 | 1/2018 | Komazawa et al. | |
| 2019/0176100 | A1 | 6/2019 | Shibata et al. | |
| 2021/0331124 | A1 | 10/2021 | Shibata et al. | |
| 2022/0387945 | A1 | 12/2022 | Shimazu | |

(Continued)

FOREIGN PATENT DOCUMENTS

| | | | |
|---|---|---|---|
| CN | 111821871 | A | 10/2020 |
| CN | 115555913 | A | 1/2023 |
| JP | 2002263678 | A | 9/2002 |

(Continued)

*Primary Examiner* — Robert A Hopkins

(74) *Attorney, Agent, or Firm* — K&L Gates LLP

(57) ABSTRACT

A fine bubble generator may include an inlet into which gas-dissolved water in which gas is dissolved flows, an outlet out of which the gas-dissolved water flows; and a fine bubble generation portion disposed between the inlet and the outlet. The fine bubble generation portion may include a venturi portion including a diameter-reducing flow path and a diameter-increasing flow path, wherein a flow path diameter of the diameter-reducing flow path reduces from upstream to downstream, and the flow path diameter of the diameter-increasing flow path increases from upstream to downstream, a discharging flow path configured to discharge the gas-dissolved water, which flowed out of the venturi portion, out of the fine bubble generation portion; and a recirculation flow path connecting a midstream of the outflow path and the venturi portion.

5 Claims, 12 Drawing Sheets

(56) References Cited

U.S. PATENT DOCUMENTS

2022/0387946 A1 12/2022 Shimazu

FOREIGN PATENT DOCUMENTS

| | | | | | |
|---|---|---|---|---|---|
| JP | 2008018330 | | | 1/2008 | |
| JP | 6118544 | B2 | | 6/2014 | |
| JP | 6048841 | B2 | | 12/2016 | |
| JP | 6077627 | | | 1/2017 | |
| JP | 2018008193 | A | | 1/2018 | |
| JP | 2018051561 | A | | 4/2018 | |
| JP | 2019166493 | A | | 10/2019 | |
| JP | 6673591 | B2 | | 3/2020 | |
| JP | 2020138153 | A | * | 9/2020 | ..... B01F 13/0079 |
| KR | 10-2215787 | B1 | | 2/2021 | |
| KR | 10-2021-0148481 | A | | 12/2021 | |
| WO | 2014084301 | A1 | | 6/2014 | |

* cited by examiner

FINE BUBBLE GENERATOR

CROSS-REFERENCE TO RELATED APPLICATION

This application claims priority to Japanese Patent Application No. 2021-094355 filed on Jun. 4, 2021, the contents of which are hereby incorporated by reference into the present application.

TECHNICAL FIELD

The art disclosed herein relates to a fine bubble generator.

BACKGROUND ART

Japanese Patent Application Publication No. 2018-8193 describes a fine bubble generator that includes an inlet into which gas-dissolved water in which gas is dissolved flows, an outlet out of which the gas-dissolved water flows, and a fine bubble generation portion disposed between the inlet and the outlet. The fine bubble generation portion includes a diameter-reducing flow path of which flow path diameter reduces from upstream to downstream, and a diameter-increasing flow path disposed downstream than the diameter-reducing flow path and having a flow path diameter that increases from upstream to downstream.

SUMMARY

In the fine bubble generator of JP 2018-8193 A, a flow speed of a water in which gas is dissolved (which may hereinbelow termed "gas-dissolved water") increases as it flows through the diameter-reducing flow path, as a result of which its pressure is reduced. Bubbles are generated as a result of this pressure reduction of the gas-dissolved water. Then, the pressure of the gas-dissolved water is gradually increased as the gas-dissolved water flows through the diameter-increasing flow path. When the pressure of the gas-dissolved water is increased after the bubbles were generated by the pressure reduction, the bubbles included in the gas-dissolved water break up into fine bubbles. As above, in the fine bubble generator, the fine bubbles are generated by the fine bubble generation portion. However, in the above fine bubble generator, a situation may occur in which the fine bubbles generated by the fine bubble generator is insufficient in volume.

The description herein provides an art configured to generate fine bubbles in large volume.

A fine bubble generator disclosed herein may comprise: an inlet into which gas-dissolved water in which gas is dissolved flows; an outlet out of which the gas-dissolved water flows; and a fine bubble generation portion disposed between the inlet and the outlet, wherein the fine bubble generation portion comprises: a venturi portion including a diameter-reducing flow path and a diameter-increasing flow path, wherein a flow path diameter of the diameter-reducing flow path reduces from upstream to downstream, and the flow path diameter of the diameter-increasing flow path increases from upstream to downstream; a discharging flow path configured to discharge the gas-dissolved water, which flowed out of the venturi portion, out of the fine bubble generation portion; and a recirculation flow path connecting a midstream of the discharging flow path and the venturi portion.

According to the above configuration, the gas-dissolved water that flowed into the fine bubble generator flows into the diameter-reducing flow path of the venturi portion in the fine bubble generation portion. A flow speed of the gas-dissolved water is increased by flowing through the diameter-reducing flow path, as a result of which its pressure is reduced. Bubbles are generated by this pressure reduction of the gas-dissolved water. Then, the pressure of the gas-dissolved water is gradually increased by flowing through the diameter-increasing flow path. When the pressure of the gas-dissolved water is increased after the bubbles were generated by the pressure reduction, the bubbles included in the gas-dissolved water break up into fine bubbles. Then, the gas-dissolved water including the fine bubbles flow through the discharging flow path and flows out of the fine bubble generation portion. In the venturi portion, a negative pressure is generated by the gas-dissolved water flowing in the venturi portion (venturi effect). Further, the recirculation flow path connects the midstream of the discharging flow path and the venturi portion. Due to this, a part of the gas-dissolved water flowing in the discharging flow path is suctioned in to the recirculation flow path due to the negative pressure generated in the venturi portion. Then, the gas-dissolved water suctioned into the recirculation flow path re-enters the venturi portion. Due to the gas-dissolved water flowing through the venturi portion again, the fine bubbles in the gas-dissolved water are refined into finer bubbles, and the volume of the fine bubbles increases. Thus, the fine bubbles can be generated in large volume.

DETAILED DESCRIPTION

Figure 1:
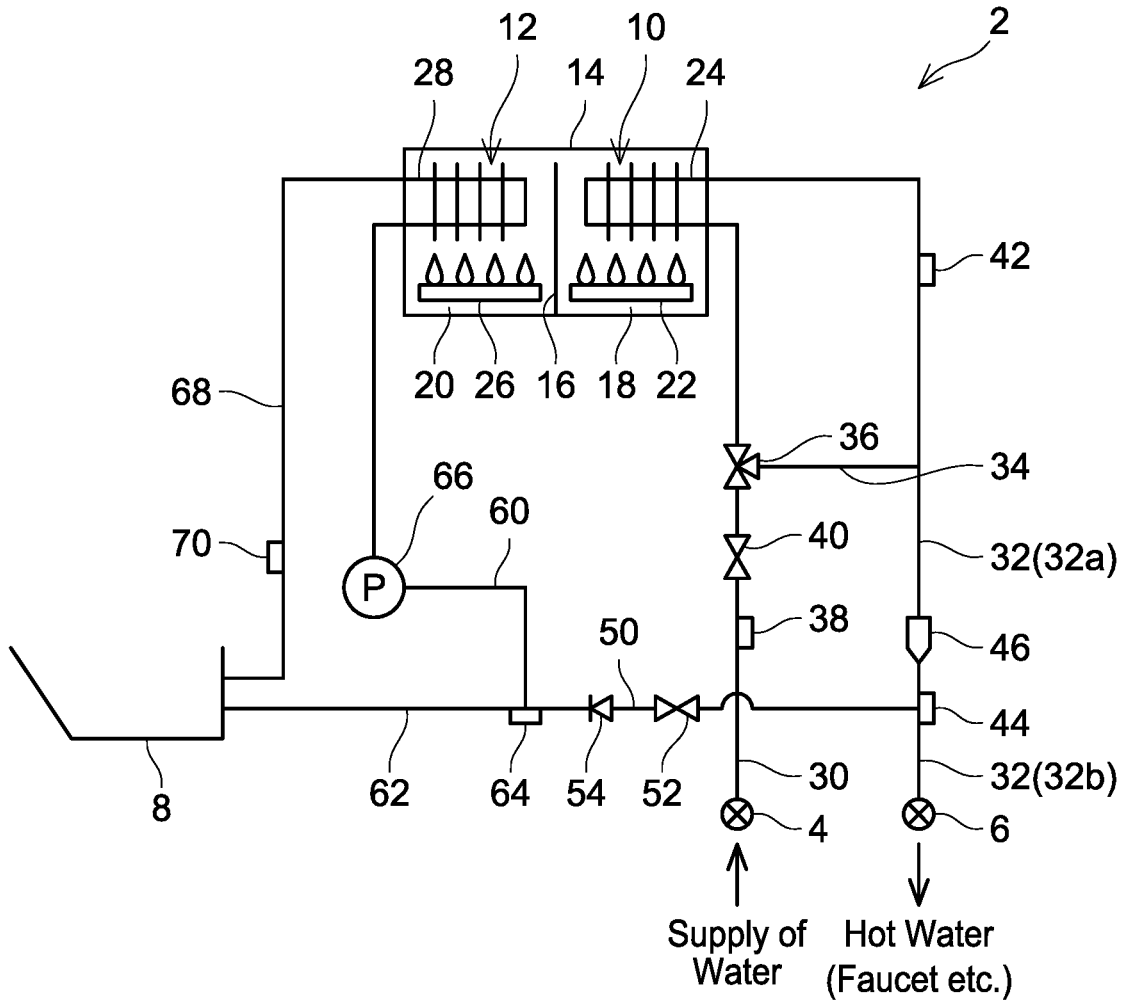
FIG. 1 schematically shows a configuration of a hot water supply system 2 of an embodiment.

A fine bubble generator disclosed herein may comprise: an inlet into which gas-dissolved water in which gas is dissolved flows; an outlet out of which the gas-dissolved water flows; and a fine bubble generation portion disposed between the inlet and the outlet, wherein the fine bubble generation portion comprises: a venturi portion including a diameter-reducing flow path and a diameter-increasing flow path, wherein a flow path diameter of the diameter-reducing flow path reduces from upstream to downstream, and the flow path diameter of the diameter-increasing flow path increases from upstream to downstream; a discharging flow path configured to discharge the gas-dissolved water, which flowed out of the venturi portion, out of the fine bubble generation portion; and a recirculation flow path connecting a midstream of the discharging flow path and the venturi portion.

In one or more embodiments, the venturi portion may further comprise a constant diameter flow path connecting a downstream end of the diameter-reducing flow path and an upstream end of the diameter-increasing flow path, wherein the flow path diameter of the constant diameter flow path is constant. The flow path diameter of the constant diameter flow path may be equal to the flow path diameter of the downstream end of the diameter-reducing flow path. The recirculation flow path may be connected to a vicinity of the downstream end of the constant diameter flow path.

In the venturi portion, a flow speed of the gas-dissolved water becomes fastest in the vicinity of the downstream end of the constant diameter flow path. Due to this, a largest negative pressure is generated in the vicinity of the downstream end of the constant diameter flow path. According to the above configuration, the recirculation flow path is connected to the vicinity of the downstream end of the constant diameter flow path. Due to this, a volume of the gas-dissolved water suctioned into the recirculation flow path from the discharging flow path can be increased. Thus, the volume of the gas-dissolved water re-entering the venturi portion increases, as a result of which fine bubbles can be generated in larger volume.

In one or more embodiments, the discharging flow path may comprise a guide wall disposed downstream of a connection where the recirculation path is connected to the discharging flow path. The guide wall may be configured to guide the gas-dissolved water flowing in the discharging flow path to the recirculation flow path.

According to the above configuration, the gas-dissolved water flowing in the discharging flow path can more easily be suctioned in to the recirculation flow path by the guide wall. Due to this, the volume of the gas-dissolved water suctioned into the recirculation flow path from the discharging flow path can be increased. Thus, the volume of the gas-dissolved water re-entering the venturi portion increases, as the result of which the fine bubbles can be generated in larger volume.

In one or more embodiments, the fine bubble generator may further comprise: a collision wall facing an opening of a downstream end of the diameter-increasing flow path, wherein the gas-dissolved water flowing out of the diameter-increasing flow path collides with the collision wall, and a side wall extending from the collision wall to a venturi portion side and surrounding at least a part of the venturi portion. The discharging flow path may include a first discharging flow path defined between the collision wall and the opening of the downstream end of the diameter-increasing flow path; and a second discharging flow path disposed downstream of the first discharging flow path and defined between the venturi portion and the side wall. The recirculation flow path may be connected to a midstream of the second discharging flow path.

According to the above configuration, the gas-dissolved water that flowed out from the diameter-increasing flow path collides with the collision wall. Due to the gas-dissolved water colliding with the collision wall, the fine bubbles in the gas-dissolved water break up and are refined into finer bubbles, and the volume of the fine bubbles increases. Further, since the recirculation flow path is connected to the midstream of the second discharging flow path downstream of the first discharging flow path, the gas-dissolved water that is suctioned into the recirculation flow path and re-enters the venturi portion collides again with the collision wall after it flows out from the diameter-increasing flow path. Due to this, the fine bubbles in the gas-dissolved water break up and are refined into even finer bubbles, and the volume of the fine bubbles further increases.

Further, according to the above configuration, the gas-dissolved water that flowed within the venturi portion in a first direction and flowed out from the venturi portion collides with the collision wall, and thereafter begins to flow in the second discharging flow path defined between the venturi portion and the side wall in a second direction opposite to the first direction. According to such a configuration, a length of the fine bubble generation portion along the first direction can be shortened as compared to a configuration in which the fine bubble generation portion does not include the side wall, and a size of the fine bubble generator can thereby be reduced.

Embodiments (Configuration of Hot Water Supply System 2; FIG. 1)

A hot water supply system 2 shown in FIG. 1 is configured to heat water supplied from a water source 4 such as a public tap water system, and deliver the water heated to a desired temperature to a faucet 6 installed in a kitchen or a bathtub 8 installed in a bathroom. Further, the hot water supply system 2 is configured capable of reheating the water in the bathtub 8.

The hot water supply system 2 includes a first heating device 10, a second heating device 12, and a burner chamber 14. The first heating device 10 is a heating device used to supply hot water to the faucet 6 and the bathtub 8. The second heating device 12 is a heating device used to reheat the water in the bathtub 8. Inside of the burner chamber 14 is partitioned into a first burner chamber 18 and a second burner chamber 20 by a wall 16. The first heating device 10 is housed in the first burner chamber 18 and the second heating device 12 is housed in the second burner chamber 20.

The first heating device 10 includes a first burner 22 and a first heat exchanger 24. The second heating device 12 includes a second burner 26 and a second heat exchanger 28.

An upstream end of the first heat exchanger 24 of the first heating device 10 is connected to a downstream end of a water supply passage 30. Water from the water source 4 is supplied to an upstream end of the water supply passage 30. A downstream end of the first heat exchanger 24 is connected to an upstream end of a hot water supply passage 32. The water supply passage 30 and the hot water supply passage 32 are connected by a bypass passage 34. A bypass servo valve 36 is disposed at a connection between the water supply passage 30 and the bypass passage 34. The bypass servo valve 36 is configured to adjust a flow rate of the water sent from the water supply passage 30 to the first heating device 10 and a flow rate of the water sent from the water supply passage 30 to the bypass passage 34. Low-temperature water delivered through the water supply passage 30 and the bypass passage 34 is mixed with high-temperature water delivered through the water supply passage 30, the first heating device 10, and the hot water supply passage 32 at a connection between the bypass passage 34 and the hot water supply passage 32. A water flow metering sensor 38 and a water flow servo valve 40 are disposed on the water supply passage 30 upstream of the bypass servo valve 36. The water flow metering sensor 38 is configured to detect a flow rate of the water that flows in the water supply passage 30. The water flow servo valve 40 is configured to adjust the flow rate of the water that flows in the water supply passage 30. A heat exchanger outlet thermistor 42 is disposed on the hot water supply passage 32 upstream of the connection thereof with the bypass passage 34.

An upstream end of a bathtub-filling passage 50 is connected to the hot water supply passage 32 downstream of the connection thereof with the bypass passage 34. A hot water-supplying thermistor 44 is disposed at a connection between the hot water supply passage 32 and the bathtub-filling passage 50. A fine bubble generator 46 is disposed between the connection of the hot water supply passage 32 and the bypass passage 34 and a connection of the hot water supply passage 32 and the bathtub-filling passage 50. The fine bubble generator 46 will be described later in detail. Hereinbelow, a part of the hot water supply passage 32 upstream of the fine bubble generator 46 may be termed a first hot water supply passage 32*a*, and a part of the hot water supply passage 32 downstream of the fine bubble generator 46 may be termed a second hot water supply passage 32*b*.

A downstream end of the bathtub-filling passage 50 is connected to an upstream end of a reheating passage 60 and a downstream end of a first bathtub circulation passage 62. A downstream end of the reheating passage 60 is connected to an upstream end of the second heat exchanger 28. An upstream end of the first bathtub circulation passage 62 is connected to the bathtub 8. A reheating control valve 52 and a check valve 54 are disposed on the bathtub-filling passage 50. The reheating control valve 52 is configured to open and close the bathtub-filling passage 50. The check valve 54 is configured to allow a waterflow from upstream to downstream of the bathtub-filling passage 50 and prohibit a waterflow from downstream to upstream of the bathtub-filling passage 50. A bathtub returning thermistor 64 is disposed at a connection between the bathtub-filling passage 50, the reheating passage 60, and the first bathtub circulation passage 62. A circulation pump 66 is disposed on the reheating passage 60.

A downstream end of the second heat exchanger 28 of the second heating device 12 is connected to an upstream end of a second bathtub circulation passage 68. A downstream end of the second bathtub circulation passage 68 is connected to the bathtub 8. A bathtub outflow thermistor 70 is disposed on the second bathtub circulation passage 68.

When the hot water supply system 2 is to supply hot water to the faucet 6, the first burner 22 of the first heating device 10 operates with the reheating control valve 52 closed. In this case, the water supplied from the water source 4 to the water supply passage 30 is heated by heat exchange in the first heat exchanger 24 and is then delivered to the faucet 6 through the hot water supply passage 32. A temperature of the water flowing in the hot water supply passage 32 can be adjusted to a desired temperature by adjusting a combustion amount of the first burner 22 of the first heating device 10 and an opening degree of the bypass servo valve 36.

When the hot water supply system 2 is to fill the bathtub 8 with hot water, the first burner 22 of the first heating device 10 operates with the reheating control valve 52 open. In this case, the water supplied from the water source 4 to the water supply passage 30 is heated by the heat exchange in the first heat exchanger 24 and then flows into the bathtub-filling passage 50 from the hot water supply passage 32. At this occasion, a temperature of the water is adjusted to a desired temperature by an adjustment of the first burner 22 of the first heating device 10 and/or adjustment of an opening degree of the bypass servo valve 36. The water that flowed into the bathtub-filling passage 50 flows into the bathtub 8 through the first bathtub circulation passage 62 and also through the reheating passage 60 and the second bathtub circulation passage 68.

When the hot water supply system 2 is to reheat the water in the bathtub 8, the circulation pump 66 operates with the reheating control valve 52 closed, and the second burner 26 of the second heating device 12 is operated. In this case, the water in the bathtub 8 flows into the first bathtub circulation passage 62 and is sent to the second heating device 12 through the reheating passage 60. The water sent to the second heating device 12 is heated by heat exchange in the second heat exchanger 28, and then flows into the second bathtub circulation passage 68. At this occasion, the temperature of the water is adjusted to a desired temperature by an adjustment of a combustion amount of the second burner 26 of the second heating device 12. The water that flowed into the second bathtub circulation passage 68 is returned into the bathtub 8.

(Configuration of Fine Bubble Generator 46; FIGS. 2 to 12)

Figure 2:
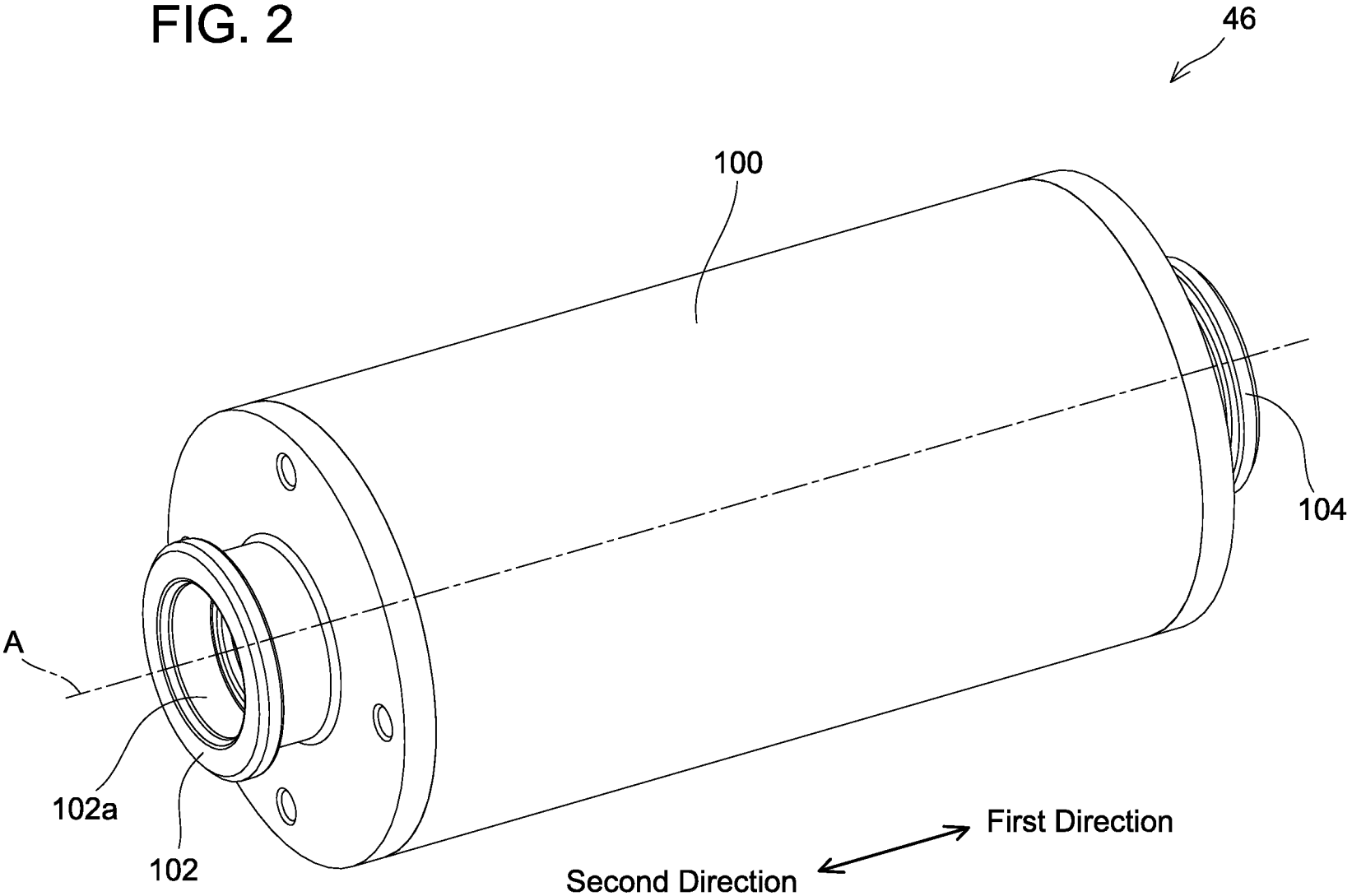
FIG. 2 is a perspective view of a fine bubble generator 46 of the embodiment.
Figure 3:
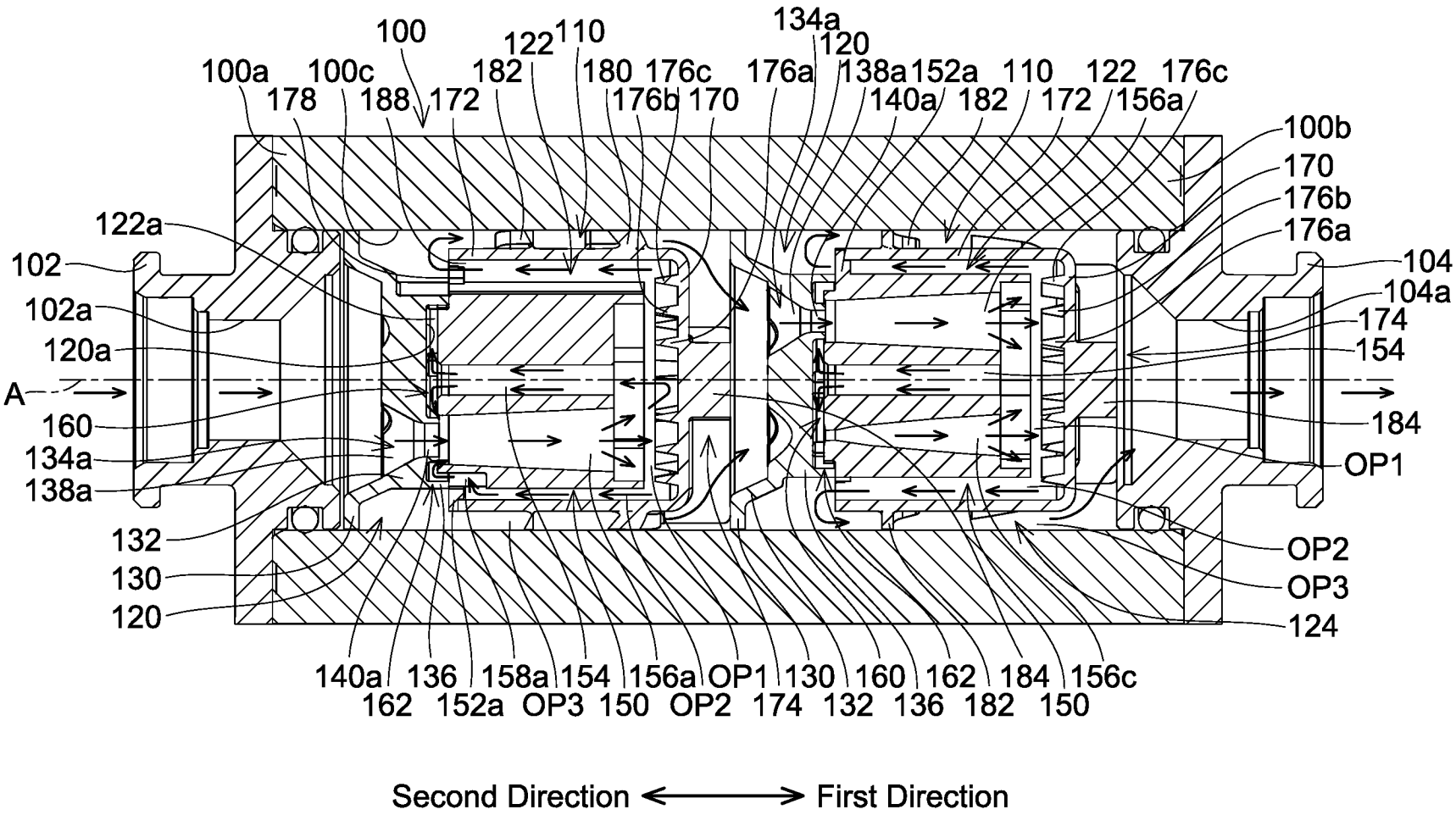
FIG. 3 is a cross-sectional view of the fine bubble generator 46 of the embodiment.

Next, the fine bubble generator 46 disposed on the hot water supply passage 32 will be described with reference to FIGS. 2 to 12. As shown in FIG. 2, the fine bubble generator 46 includes a main body casing 100, an inlet 102, and an outlet 104. The main body casing 100 has a cylindrical shape. As shown in FIG. 3, the inlet 102 is fixed to a first end 100*a* of the main body casing 100 by screws (not shown). An inlet opening 102*a* is defined in the inlet 102. The inlet 102 is connected to a downstream end of the first hot water supply passage 32*a* (see FIG. 1). The outlet 104 is fixed to a second end 100*b* of the main body casing 100 by screws (not shown). An outlet opening 104*a* is defined in the outlet 104. The outlet 104 is connected to an upstream end of the second hot water supply passage 32*b* (see FIG. 1). Hereinbelow, a direction along which the water enters the inlet 102 from the first hot water supply passage 32*a* will be termed "first direction", and a direction opposite to the first direction will be termed "second direction". That is, right and left directions in FIG. 3 are respectively an example of the "first direction" and the "second direction".

The main body casing 100 houses two fine bubble generation portions 110. The two fine bubble generation portions 110 are disposed along a center axis A of the fine bubble generator 46. Hereinbelow, the center axis A of the fine bubble generator 46 may simply be termed "center axis A".

(Configuration of Fine Bubble Generation Portions 110; FIGS. 3 to 12)

Figure 4:
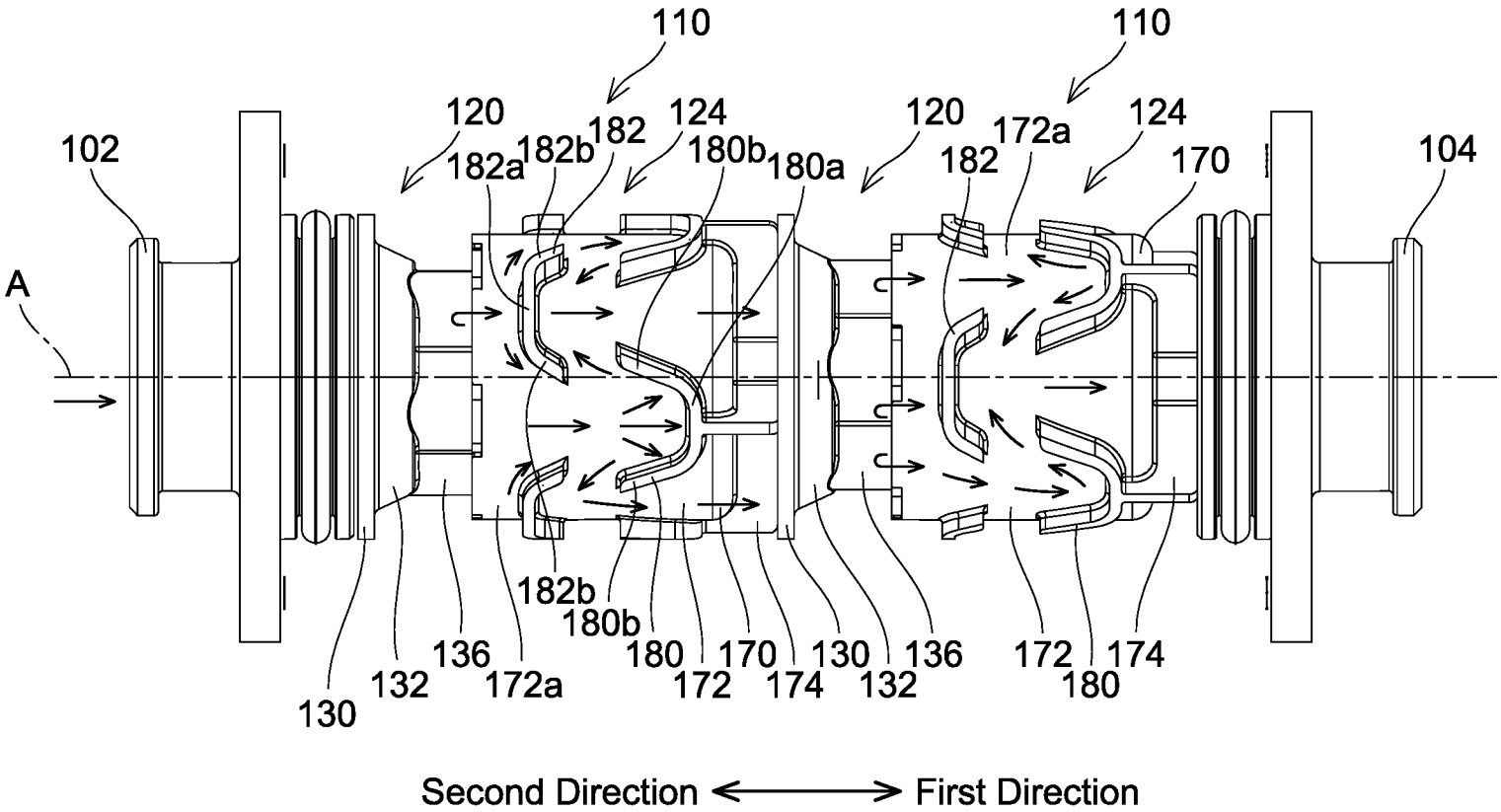
FIG. 4 shows a side view in a state having detached a main body casing 100 of the fine bubble generator 46 of the embodiment.
Figure 5:
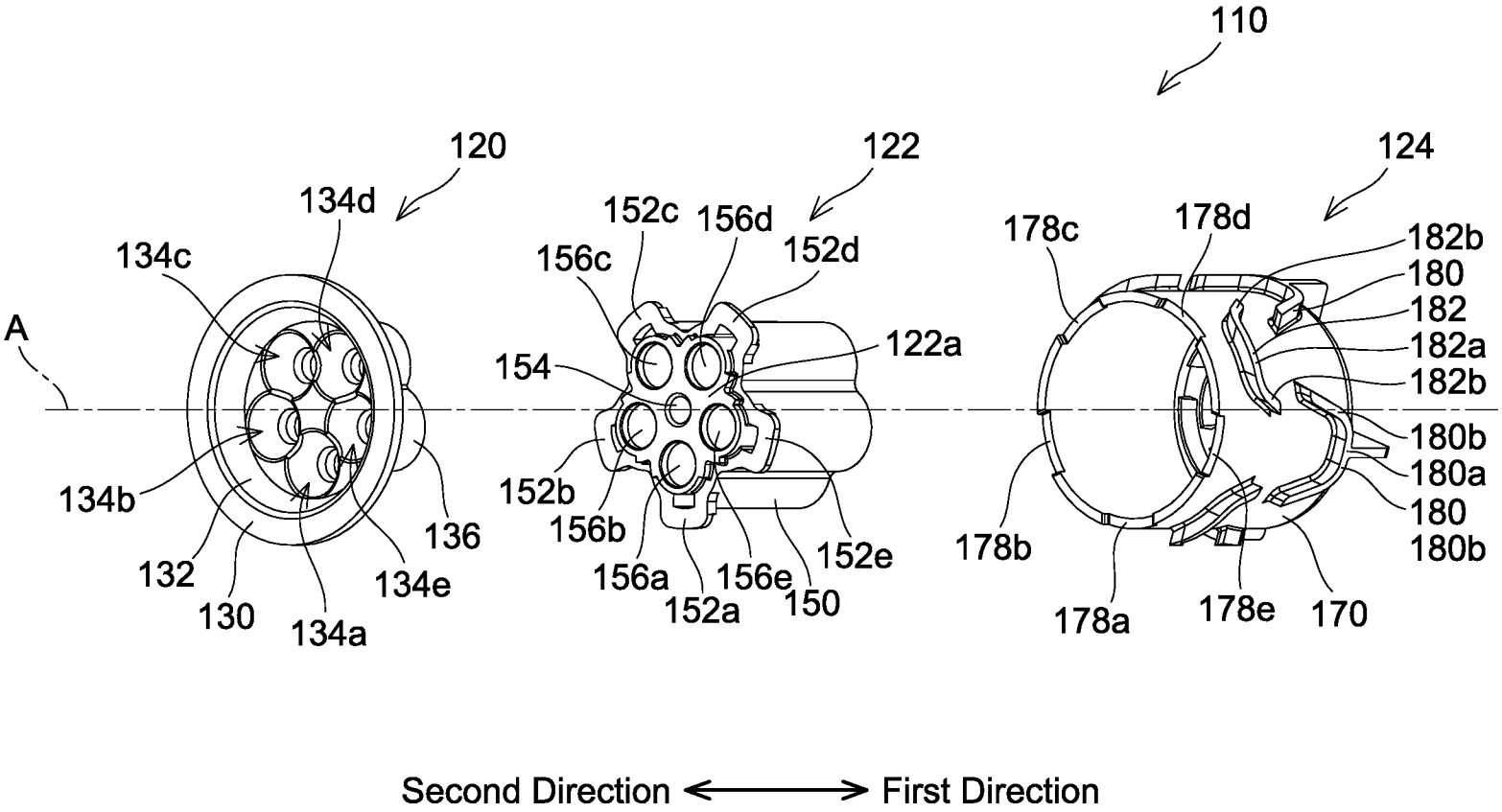
FIG. 5 is a disassembled diagram seeing a fine bubble generation portion 110 of the embodiment from a second direction side.
Figure 6:
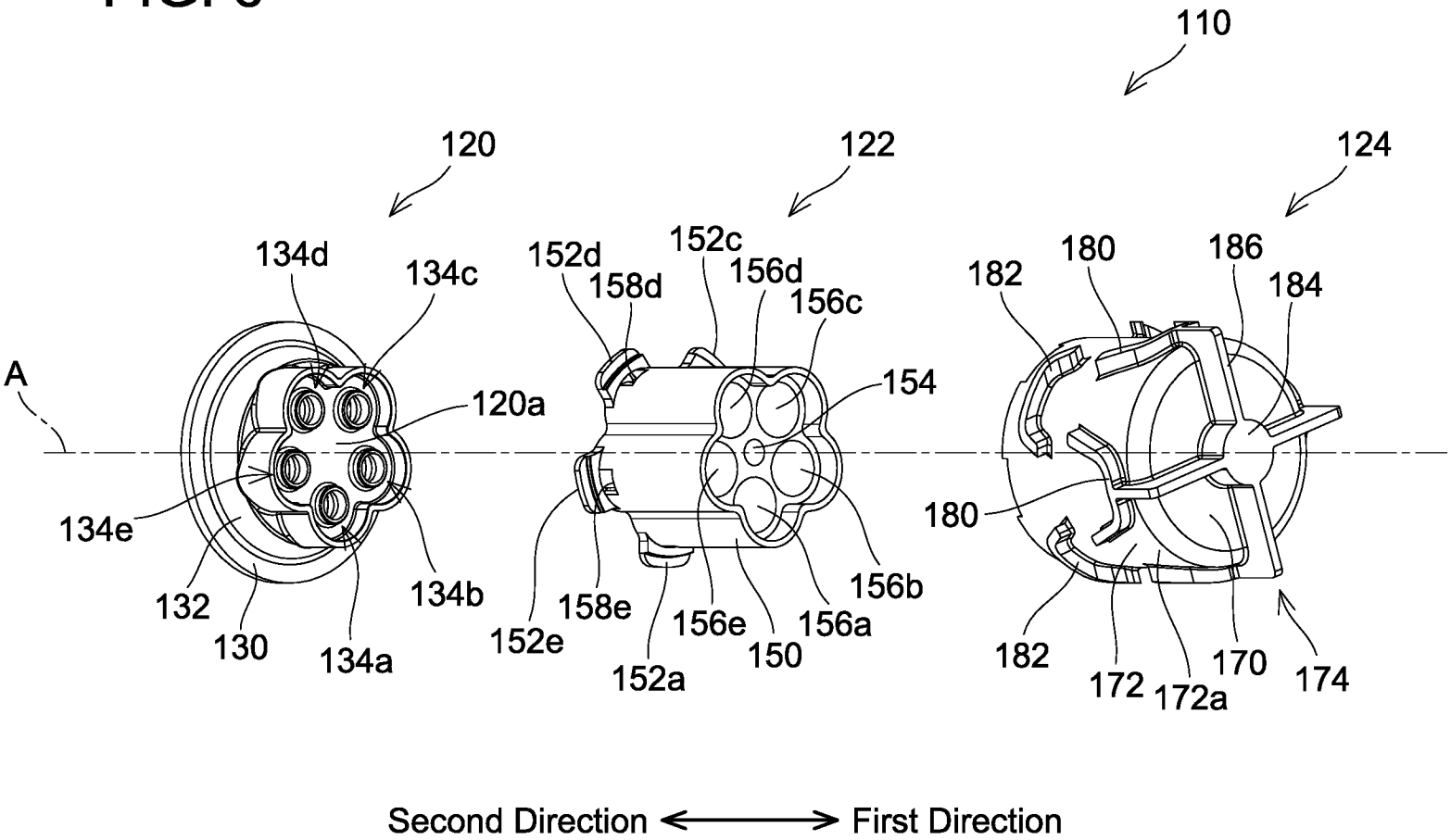
FIG. 6 is a disassembled diagram seeing the fine bubble generation portion 110 of the embodiment from a first direction side.

Next, the fine bubble generation portions 110 will be described with reference to FIGS. 3 to 12. As shown in FIGS. 5 and 6, each fine bubble generation portion 110 includes a first main body 120, a second main body 122, and a third main body 124. The first main body 120, the second main body 122, and the third main body 124 are disposed along the center axis A. The first main body 120, the second main body 122, and the third main body 124 are arranged in an order of the first main body 120, the second main body 122, and the third main body 124 from a second direction side to a first direction side.

As shown in FIGS. 5 and 6, the first main body 120 includes a first flange 130, a cylindrical portion 132, five flow path portions 134*a* to 134*e*, and an outer peripheral portion 136. As shown in FIG. 3, a diameter of the cylindrical portion 132 reduces toward the first direction side. The first flange 130 extends outward along a radial direction of the center axis A from a second direction-side end of the cylindrical portion 132. An outer diameter of the first flange 130 is same as an inner diameter of the main body casing 100.

Figure 7:
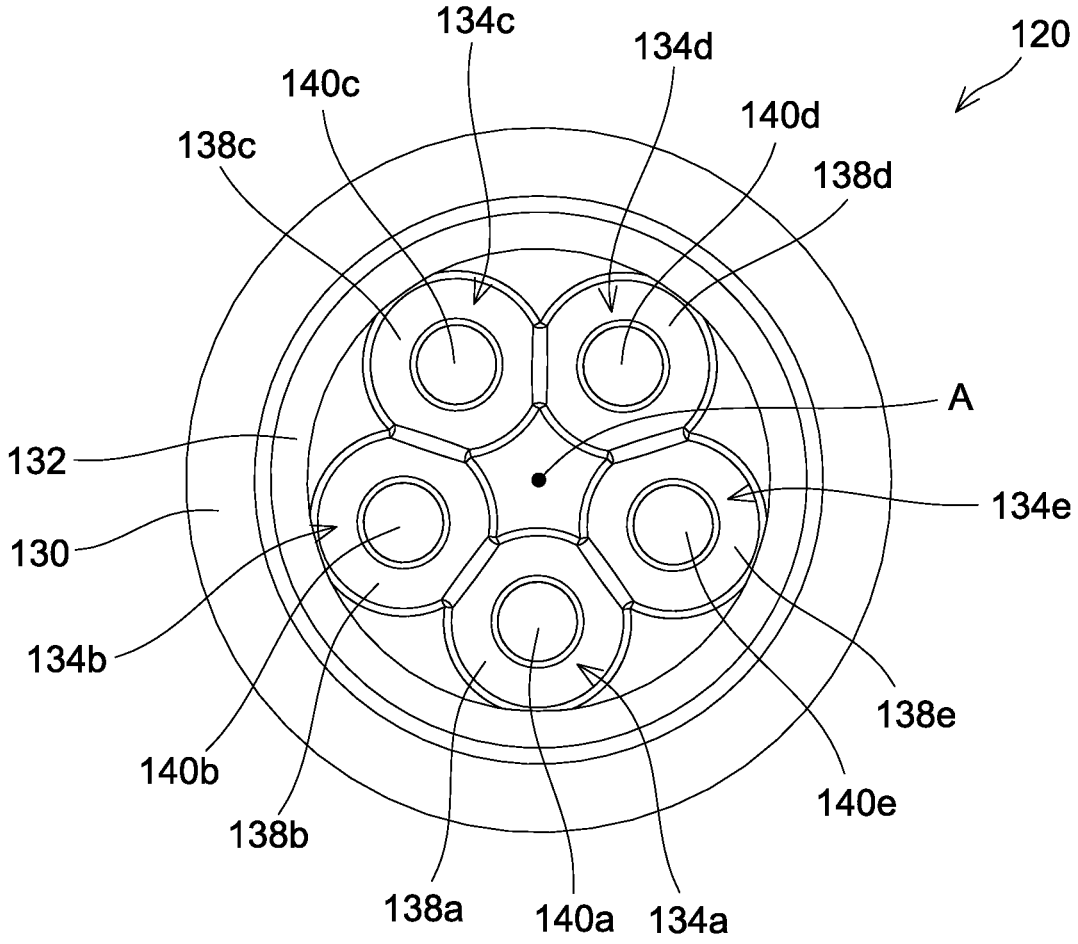
FIG. 7 shows a first main body 120 of the embodiment as seen from a second direction side.
Figure 8:
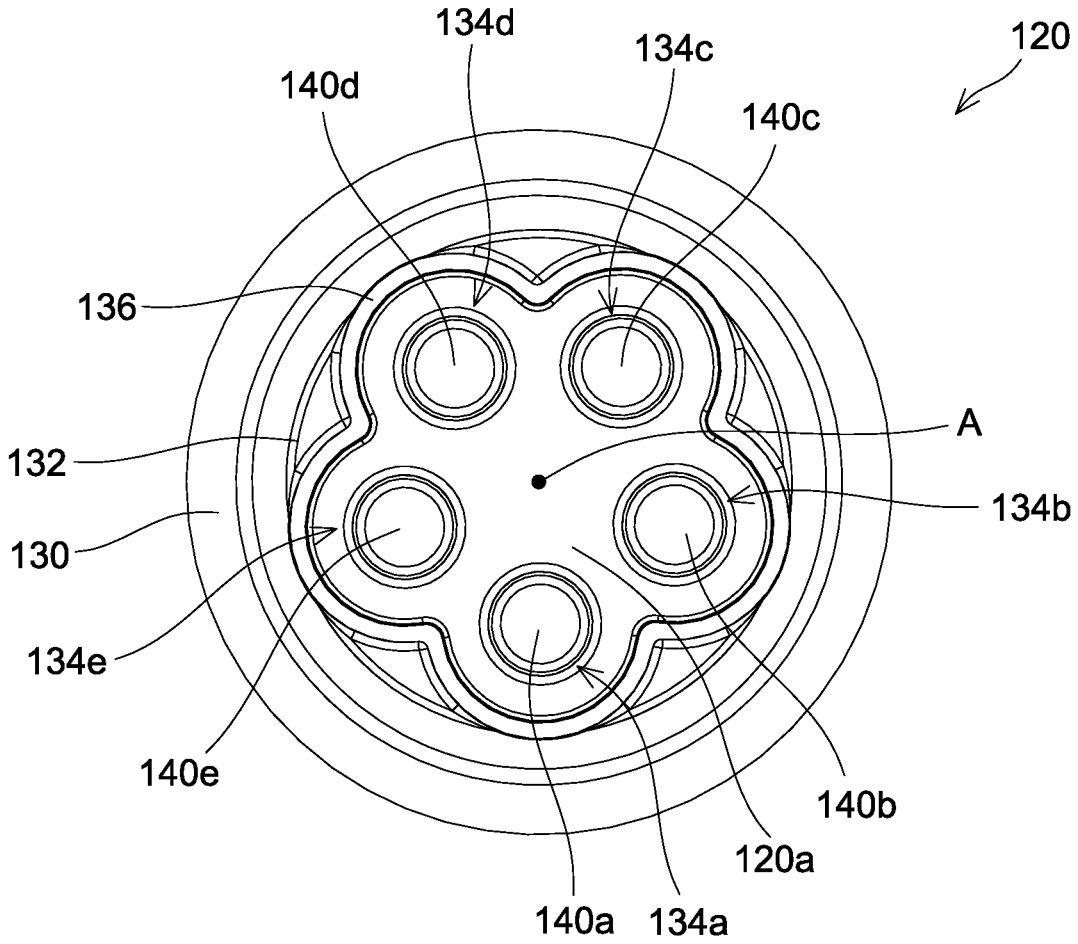
FIG. 8 shows the first main body 120 of the embodiment as seen from a first direction side.

As shown in FIGS. 7 and 8, the five flow path portions 134*a* to 134*e* are arranged at regular intervals along a circumferential direction about the center axis A. Hereinbelow, the flow path portions 134*a* to 134*e* may collectively be termed "flow path portions 134". As shown in FIG. 3, the flow path portions 134 extend to the first direction side from a first direction-side end of the cylindrical portion 132. The flow path portions 134 extend parallel to the center axis A. The flow path portions 134*a* to 134*e* include diameter-reducing flow paths 138*a* to 138*e* and constant diameter flow paths 140*a* to 140*e*. Hereinbelow, the diameter-reducing flow paths 138*a* to 138*e* and the constant diameter flow paths 140*a* to 140*e* may collectively be termed "diameter-reducing flow paths 138" and "constant diameter flow paths 140", respectively. A flow path diameter of the diameter-reducing flow paths 138 reduces toward the first direction side. The water that flowed into the flow path portions 134 flow through the diameter-reducing flow paths 138 in the first direction. As such, the flow path diameter of the diameter-reducing flow paths 138 reduces from upstream to downstream. The flow path diameter of the diameter-reducing flow paths 138 at their second direction-side ends is smaller than a flow path diameter of the inlet opening 102*a* of the inlet 102. Second direction-side ends of the constant diameter flow paths 140 (that is, their upstream ends) are respectively connected to first direction-side ends of the diameter-reducing flow paths 138 (that is, their downstream ends). Further, first direction-side ends of the constant diameter flow paths 140 (that is, their downstream ends) are respectively connected to second direction-side ends of diameter-increasing flow paths 156 to be described later (that is, their upstream ends). A flow path diameter of the constant diameter flow paths 140 is constant in a direction parallel to the center axis A. The flow path diameter of the constant diameter flow paths 140 is same as the flow path diameter of the first direction-side ends of the diameter-reducing flow paths 138 (that is, their downstream ends). In the present embodiment, the five diameter-reducing flow paths 138*a* to 138*e* have a same shape, however, at least one of the five diameter-reducing flow paths 138*a* to 138*e* may have a different shape from the others. Further, in the present embodiment, the five constant diameter flow paths 140*a* to 140*e* have a same shape, however, at least one of the five constant diameter flow paths 140*a* to 140*e* may have a different shape from the others.

As shown in FIG. 3, the outer peripheral portion 136 extends in the first direction from the first direction-side end of the cylindrical portion 132. As shown in FIG. 8, the outer peripheral portion 136 surrounds the constant diameter flow paths 140 on their radially outer side with respect to the center axis A. An outer shape of the outer peripheral portion 136 is defined by five arch shapes. A diameter of these arches is larger than the diameter of the constant diameter flow paths 140. As shown in FIG. 3, a first direction-side end of the outer peripheral portion 136 is located more on the first direction side than the first direction-side ends of the constant diameter flow paths 140 are.

Figure 9:
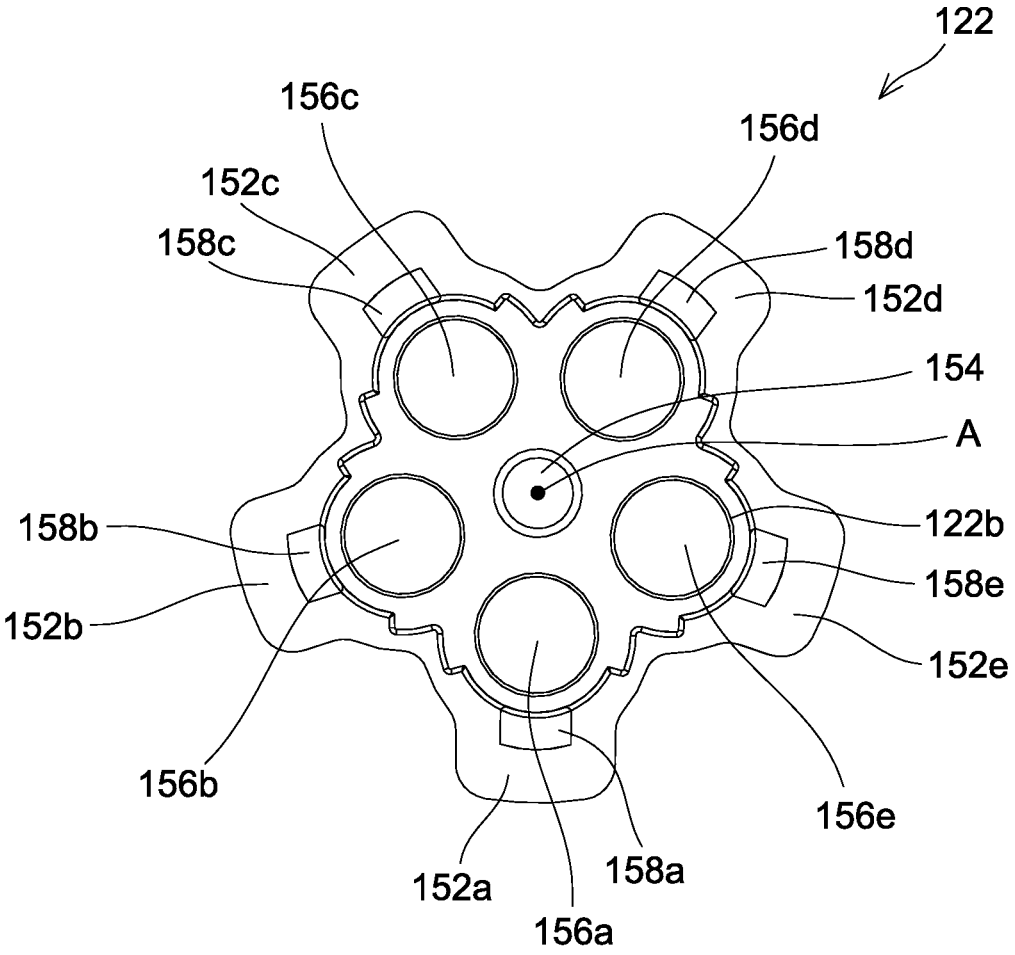
FIG. 9 shows a second main body 122 of the embodiment as seen from the second direction side.
Figure 10:
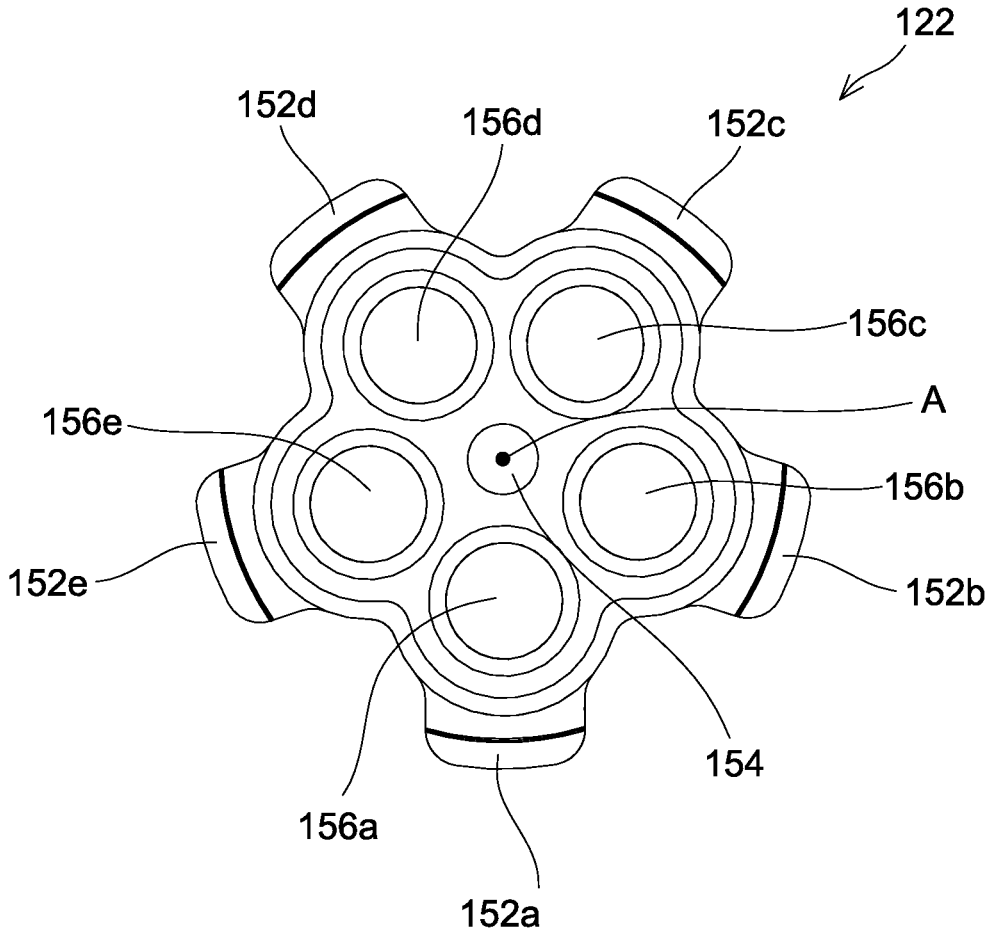
FIG. 10 shows the second main body 122 of the embodiment as seen from the first direction side.

As shown in FIGS. 5 and 6, the second main body 122 includes an inner casing 150 and five second flanges 152*a* to 152*e*. Hereinbelow, the five second flanges 152*a* to 152*e* may collectively be termed "second flanges 152". As shown in FIG. 6, an outer shape of the inner casing 150 is defined by five arch shapes. A connection flow path 154 and five diameter-increasing flow paths 156*a* to 156*e* are defined in the inner casing 150. Hereinbelow, the five diameter-increasing flow paths 156*a* to 156*e* may collectively be termed "diameter-increasing flow paths 156". The connection flow path 154 is disposed at a central area of the inner casing 150, and extends along the center axis A. As shown in FIG. 3, a flow path diameter of the connection flow path 154 is constant. As shown in FIG. 9, the diameter-increasing flow paths 156 are disposed radially outside the connection flow path 154. The diameter-increasing flow paths 156 are arranged at regular intervals along the circumferential direction about the center axis A. As shown in FIG. 3, the five diameter-increasing flow paths 156*a* to 156*e* are disposed corresponding to the five constant diameter flow paths 140*a* to 140*e* of the first main body 120 at positions on the first direction side of the five constant diameter flow paths 140*a* to 140*e*. A flow path diameter of the diameter-increasing flow paths 156 increases toward the first direction side. The water that flowed into the second main body 122 flows through the diameter-increasing flow paths 156 toward the first direction side. As such, the flow path diameter of the diameter-increasing flow paths 156 increases from upstream to downstream. The flow path diameter of second direction-side ends of the diameter-increasing flow paths 156 is larger than the flow path diameter of the constant diameter flow paths 140. In the center axis A direction, positions of the second direction-side ends of the diameter-increasing flow paths 156 match positions of the first direction-side ends of the constant diameter flow paths 140. Further, clearances are secured between the diameter-increasing flow paths 156 and the constant diameter flow paths 140 at the second direction-side ends of the diameter-increasing flow paths 156. Further, the second direction-side ends of the diameter-increasing flow paths 156 (that is, a second direction-side end 122*a* of the second main body 122) are disposed radially inside the outer peripheral portion 136 of the first main body 120. In the center axis A direction, the end 122*a* of the second main body 122 is located on the first direction side than an inner end 120*a* of the first main body 120 is. The inner end 120*a* of the first main body 120 is disposed radially inside the outer peripheral portion 136. Due to this, in the center axis A direction, a clearance is secured between the end 122*a* of the second main body 122 and the inner end 120*a* of the first main body 120. Further, the flow path diameter of first direction-side ends of the diameter-increasing flow paths 156 (that is, their downstream ends) is same as the flow path diameter of second direction-side ends of the diameter-reducing flow paths 138 of the first main body 120 (that is, their upstream ends). In the present embodiment, a venturi portion is constituted of the diameter-reducing flow paths 138, the constant diameter flow paths 140, and the diameter-increasing flow paths 156. Due to this, hereinbelow, the diameter-reducing flow paths 138, the constant diameter flow paths 140, and the diameter-increasing flow paths 156 may collectively be termed "venturi portion". In the present embodiment, the five diameter-increasing flow paths 156*a* to 156*e* have a same shape, however, at least one of the five diameter-increasing flow paths 156*a* to 156*e* may have a different shape from the others.

As shown in FIG. 6, the second flanges 152 extend radially outward from a second direction-side end of the inner casing 150. As shown in FIG. 9, the five second flanges 152*a* to 152*e* are respectively disposed radially outside the five diameter-increasing flow paths 156*a* to 156*e*. As shown in FIGS. 6 and 9, through holes 158*a* to 158*e* are defined in the second direction-side end of the inner casing 150. Hereinbelow, the five through holes 158*a* to 158*e* may collectively be termed "through holes 158". The five through holes 158*a* to 158*e* are respectively disposed between the five diameter-increasing flow paths 156*a* to 156*e* and the five second flanges 152*a* to 152*e*. As shown in FIG. 3, first direction-side ends of the through holes 158 are located more on the first direction side than first direction-side ends of the second flanges 152 are.

As shown in FIGS. 5 and 6, the third main body 124 includes a bottom wall 170, a cylindrical portion 172 extending in the second direction from an outer edge of the bottom wall 170, and an extended portion 174 extending in the first direction from a first direction-side surface of the bottom wall 170. The bottom wall 170 has a circular disc shape. As shown in FIG. 3, the bottom wall 170 faces openings of the first direction-side ends of the diameter-increasing flow paths 156 of the second main body 122 (that is, their downstream ends). An outer diameter of the bottom wall 170 is smaller than the inner diameter of the main body casing 100. An outer diameter of the cylindrical portion 172 is same as the outer diameter of the bottom wall 170. The cylindrical portion 172 is disposed radially outside the second main body 122.

Figure 11:
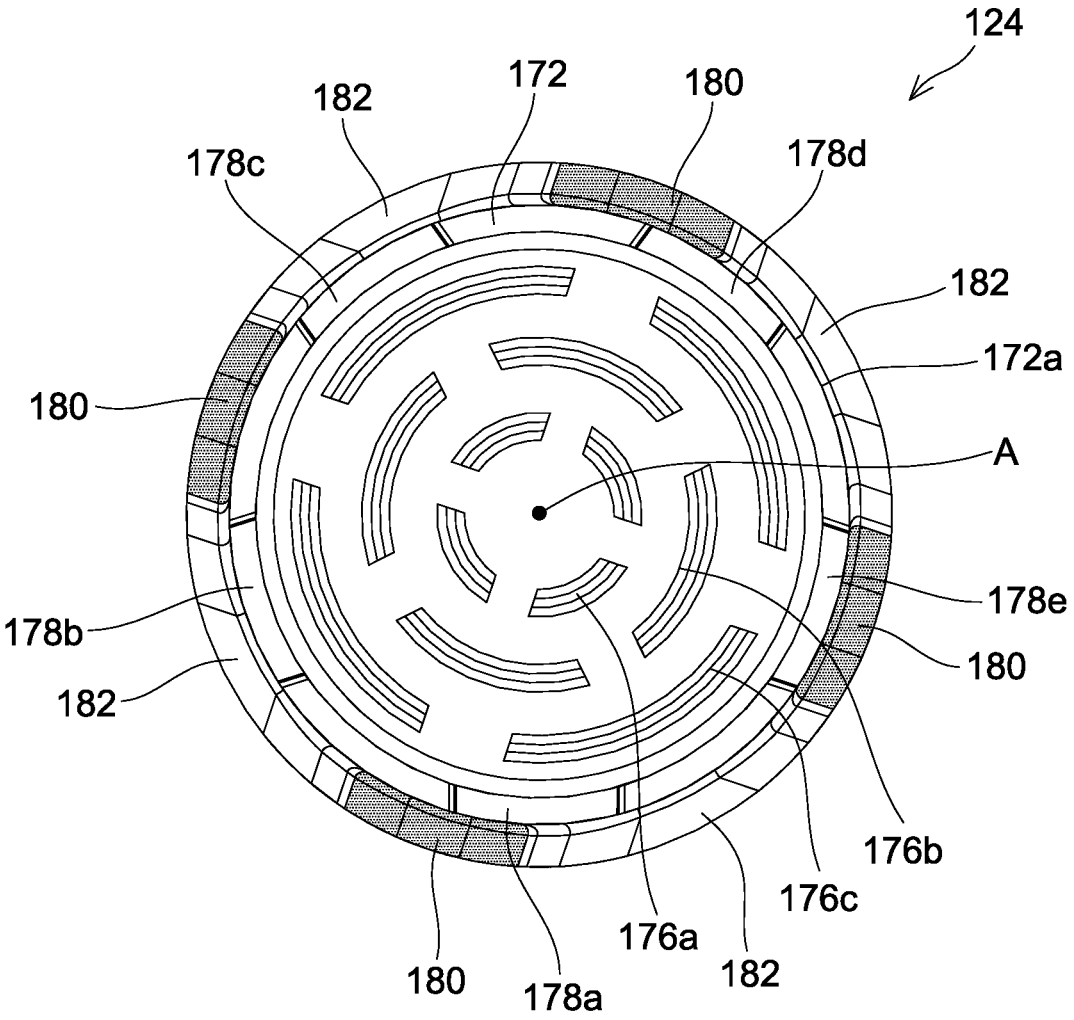
FIG. 11 shows a third main body 124 of the embodiment as seen from the second direction side.
Figure 12:
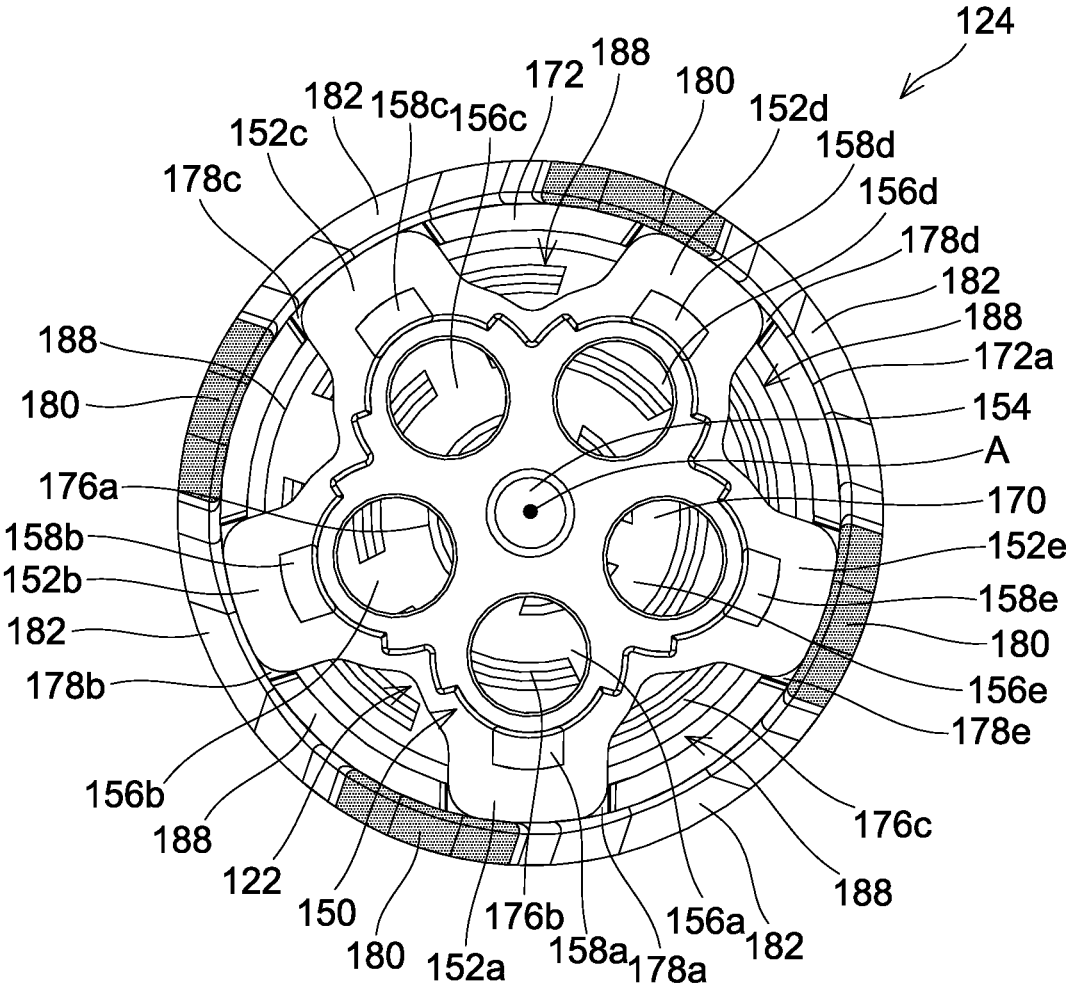
FIG. 12 shows the second main body 122 and the third main body 124 of the embodiment as seen from the second direction side.

Protrusions 176*a* to 176*c* protruding in the second direction are disposed on a second direction-side surface of the bottom wall 170. As shown in FIG. 11, the protrusions 176*a* to 176*c* are respectively disposed along the radial direction of the center axis A, in the order of the protrusions 176*a*, the protrusions 176*b*, and the protrusions 176*c* along the radially outward direction. The protrusions 176*a* to 176*c* are respectively constituted of four arch shapes. As shown in FIG. 3, second direction-side ends of the protrusions 176*a* to 176*c* are located more on the first direction side than a first direction-side end of the inner casing 150 is. As shown in FIGS. 5 and 11, five cutout portions 178*a* to 178*e* are defined in a second direction-side end of the cylindrical portion 172. The cutout portions 178*a* to 178*e* are arranged at regular intervals along the circumferential direction about the center axis A. Hereinbelow, the five cutout portions 178*a* to 178*e* may collectively be termed "cutout portions 178". As shown in FIG. 12, the five cutout portions 178*a* to 178*e* are disposed at positions respectively corresponding to the five second flanges 152*a* to 152*e*. In a state where the second flanges 152 are inserted in the cutout portions 178, an opening 188 is defined between the second direction-side end of the cylindrical portion 172 and each pair of second flanges 152 adjacent to each other in the circumferential direction.

As shown in FIGS. 5, 6, 11, and 12, four first water receivers 180 and four second water receivers 182 are connected on an outer circumferential wall 172*a* of the cylindrical portion 172. In FIGS. 11 and 12, the four first water receivers 180 are depicted in gray for easier understanding. The first water receivers 180 and the second water receivers 182 extend radially outward from the outer circumferential wall 172*a*. As shown in FIG. 4, the first water receivers 180 each include a circumferential wall 180*a* extending along an outer circumferential surface of the cylindrical portion 172 in the circumferential direction and axial extension portions 180*b* extending toward the second direction side from ends of the circumferential wall 180*a* in the circumferential direction. The axial extension portions 180*b* are each inclined in a direction separating away from a central area of the circumferential wall 180*a* at a greater degree on the second direction side. The first water receivers 180 are disposed more on the first direction side than the second water receivers 182 are. The second water receivers 182 are each disposed between the first water receivers 180 that are adjacent to each other in the circumferential direction. The second water receivers 182 each include a circumferential wall 182*a* extending along the outer circumferential surface of the cylindrical portion 172 in the circumferential direction and axial extension portions 182*b* extending toward the first direction side from ends of the circumferential wall 182*a* in the circumferential direction. The axial extension portions 182*b* are each inclined in a direction separating away from the central area of the circumferential wall 182*a* at a greater degree on the first direction side. As shown in FIG. 3, the first water receivers 180 and the second water receivers 182 are in contact with an inner circumferential wall 100*c* of the main body casing 100.

As shown in FIG. 6, the extended portion 174 includes a columnar portion 184 and four radially-extended portions 186. A center axis of the columnar portion 184 coincides with the center axis A. As shown in FIG. 3, an outer diameter of the columnar portion 184 is smaller than the outer diameter of the bottom wall 170. The radially-extended portions 186 extend radially outward from the columnar portion 184 in directions apart from each other. The four radially-extended portions 186 are arranged at regular intervals along the circumferential direction about the center axis A.

The fine bubble generation portion 110 on the second direction side and the fine bubble generation portion 110 on the first direction side have the same shape and configuration, however, they are arranged such that positions of the diameter-reducing flow paths 138, etc. in the circumferential direction are different between them as seen along the center axis A direction.

Next, fine bubbles generated by the fine bubble generator 46 will be described with reference to FIGS. 3 and 4. Solid-line arrows in FIGS. 3 and 4 indicate directions of water flow. The fine bubble generator 46 of the present embodiment is configured to generate fine bubbles using air contained in the water supplied from the water source 4, such as the public tap water system. The water supplied from the public tap water system has air (oxygen, carbon dioxide, nitrogen, etc.) dissolved therein. Hereinbelow, water in which air is dissolved will be termed "air-dissolved water". Further, hereinbelow, explanation will be given by assuming a situation in which the faucet 6 is operated by a user. As shown in FIG. 1, when the faucet 6 is operated by the user, the first burner 22 of the first heating device 10 operates with the reheating control valve 52 closed. The air-dissolved water supplied from the water source 4 to the water supply passage 30 is heated by heat exchange in the first heat exchanger 24, and then flows into the fine bubble generator 46 through the first hot water supply passage 32*a*.

Prior to explaining the fine bubbles generated by the fine bubble generator 46, reason why the fine bubble generator 46 is disposed on the first hot water supply passage 32*a* will be described. A dissolved air quantity indicating a quantity of air dissolvable in water becomes smaller in water with higher temperature. Further, bubbles are generated easier when the quantity of air dissolved in water is closer to the dissolved air quantity. Although details will be given later, in the fine bubble generator 46, bubbles are generated in the air-dissolved water, and fine bubbles are generated by refining the bubbles. Due to this, a volume of the fine bubbles can be increased when a larger volume of bubbles are generated from the air-dissolved water. Due to this reason, the fine bubble generator 46 in the present embodiment is disposed on the first hot water supply passage 32*a* where the water heated by the first heating device 10 flows.

As shown in FIG. 3, the air-dissolved water that flowed into the fine bubble generator 46 flows through the inlet opening 102*a* of the inlet 102 and into the second direction-side fine bubble generation portion 110 being one of the two fine bubble generation portions 110. The air-dissolved water that flowed into the fine bubble generation portion 110 flows into the diameter-reducing flow paths 138 of the flow path portions 134. The air-dissolved water that flowed into the diameter-reducing flow paths 138 increases its flow speed as it flows through the diameter-reducing flow paths 138, and its pressure is reduced as a result. Bubbles are generated as a result of the pressure of the air-dissolved water being reduced. The air-dissolved water that flowed through the diameter-reducing flow paths 138 flows into the constant diameter flow paths 140. The flow speed of the water that flowed into the constant diameter flow paths 140 is stabilized by flowing through the constant diameter flow paths 140. Then, the air-dissolved water that flowed through the constant diameter flow paths 140 flows into the diameter-increasing flow paths 156 in the inner casing 150 of the second main body 122. The air-dissolved water that flowed into the diameter-increasing flow paths 156 reduces its flow speed as it flows through the diameter-increasing flow paths 156, and its pressure is increased as a result. When the pressure of the air-dissolved water is increased after the bubbles were generated by the pressure reduction, the bubbles contained in the air-dissolved water break up into fine bubbles. The water that flowed through the diameter-increasing flow paths 156 flows out toward the bottom wall 170 of the third main body 124. That is, the water that flowed through the diameter-increasing flow paths 156 flows out to a first discharging flow path OP1 defined between the first direction-side end of the inner casing 150 and the bottom wall 170. The air-dissolved water that flowed out to the first discharging flow path OP1 collides with the bottom wall 170 and the protrusions 176*a* to 176*c*. By the air-dissolved water colliding with the bottom wall 170 and the protrusions 176*a* to 176*c*, the fine bubbles in the air-dissolved water break up and are refined into finer bubbles, and the volume of the fine bubbles increases.

A negative pressure is generated in the venturi portion by the air-dissolved water flowing in the venturi portion. Especially, a large negative pressure is generated in vicinity of the first direction-side ends of the constant diameter flow paths 140 (that is, their downstream ends). As described above, the clearances are secured between the diameter-increasing flow paths 156 and the constant diameter flow paths 140 at the second direction-side ends of the diameter-increasing flow paths 156. Further, in the center axis A direction, the clearance is secured between the end 122*a* of the second main body 122 and the inner end 120*a* of the first main body 120. Further, the vicinity of the first direction-side ends of the constant diameter flow paths 140 and the first discharging flow path OP1 are communicated via the connection flow path 154, the clearance between the first direction-side inner end 120*a* of the first main body 120 and the second direction-side end 122*a* of the second main body 122, and the clearances between the diameter-increasing flow paths 156 and the constant diameter flow paths 140. Hereinbelow, the connection flow path 154, the clearance between the first direction-side inner end 120*a* of the first main body 120 and the second direction-side end 122*a* of the second main body 122, and the clearances between the diameter-increasing flow paths 156 and the constant diameter flow paths 140 may collectively be termed "first recirculation flow path 160". A part of the air-dissolved water that collided with the bottom wall 170 and the protrusions 176*a* to 176*c* is suctioned into the first recirculation flow path 160 (more specifically, the connection flow path 154) by the negative pressure generated in the vicinity of the first direction-side ends of the constant diameter flow paths 140. Then, the air-dissolved water suctioned into the first recirculation flow path 160 flows through the first recirculation flow path 160 and re-enters the diameter-increasing flow paths 156. The air-dissolved water that re-entered the diameter-increasing flow paths 156 reduces its flow speed again as it flows through the diameter-increasing flow paths 156, as the result of which its pressure is increased. Due to this, the bubbles included in the air-dissolved water breaks up and becomes even finer bubbles. Further, the air-dissolved water that re-entered and flowed through the diameter-increasing flow paths 156 again collides with the bottom wall 170 and the protrusions 176*a* to 176*c* again. Due to this as well, the bubbles included in the air-dissolved water breaks up and becomes even finer bubbles. The vicinity of the first direction-side ends of the constant diameter flow paths 140 (that is, their downstream ends) refers to an area more on the first direction side (that is, downstream side) than the center portions of the constant diameter flow paths 140 in the center axis A direction are and more on the second direction side (that is, upstream side) than the center portions of the diameter-increasing flow paths 156 in the center axis A direction are. Further, within the vicinity of the first direction-side ends of the constant diameter flow paths 140, a large negative pressure is generated especially at the first direction-side ends of the constant diameter flow paths 140 (that is, their downstream ends) and the second direction-side ends of the diameter-increasing flow paths 156 (that is, their upstream ends). Due to this, a greater volume of the air-dissolved water can be caused to be suctioned into the first recirculation flow path 160 (more specifically, the connection flow path 154) by connecting the first recirculation flow path 160 to the first direction-side ends of the constant diameter flow paths 140 (that is, their downstream ends) and the second direction-side ends of the diameter-increasing flow paths 156 (that is, their upstream ends).

Further, a part of the air-dissolved water that collided with the bottom wall 170 and the protrusions 176*a* to 176*c* flows into a second discharging flow path OP2 defined between the outer wall of the inner casing 150 of the second main body 122 and the inner wall of the cylindrical portion 172 of the third main body 124. The water that flowed into the second discharging flow path OP2 flows within the second discharging flow path OP2 from the first direction side to the second direction side, and reaches the second direction-side end of the inner casing 150.

As shown in FIGS. 3 and 12, the second flanges 152 are disposed at the second direction-side end of the inner casing 150. The flow of the air-dissolved water is blocked by the air-dissolved water when it reaches the portions of the second direction-side end of the inner casing 150 where the second flanges 152 are disposed and comes into contact with the second flanges 152. The through holes 158 are defined on the first direction side (that is, on the upstream side) of the second flanges 152. That is, the through holes 158 are disposed midstream of the second discharging flow path OP2. As described above, at the second direction-side ends of the diameter-increasing flow paths 156, the clearances are secured between the diameter-increasing flow paths 156 and the constant diameter flow paths 140. Further, in the center axis A direction, the clearance is secured between the end 122*a* of the second main body 122 and the inner end 120*a* of the first main body 120. Further, the clearances secured between the diameter-increasing flow paths 156 and the constant diameter flow paths 140 communicate with the clearance secured between the end 122*a* of the second main body 122 and the inner end 120*a* of the first main body 120. Due to this, the vicinity of the first direction-side ends of the constant diameter flow paths 140 (that is, their downstream ends) and the midstream of the second discharging flow path OP2 are communicated via the through holes 158, the clearance between the first direction-side inner end 120*a* of the first main body 120 and the second direction-side end 122*a* of the second main body 122, and the clearances between the diameter-increasing flow paths 156 and the constant diameter flow paths 140. Hereinbelow, the through holes 158, the clearance between the first direction-side inner end 120*a* of the first main body 120 and the second direction-side end 122*a* of the second main body 122, and the clearances between the diameter-increasing flow paths 156 and the constant diameter flow paths 140 may collectively be termed "second recirculation flow path 162". As described above, a large negative pressure is generated in the vicinity of the first direction-side ends of the constant diameter flow paths 140 (that is, their downstream ends). Due to this, the part of the air-dissolved water blocked by the second flanges 152 is suctioned into the second recirculation flow path 162 (more specifically, the through holes 158) by the negative pressure generated in the vicinity of the first direction-side ends of the constant diameter flow paths 140. Then, the air-dissolved water suctioned into the second recirculation flow path 162 flows through the second recirculation flow path 162 and re-enters the diameter-increasing flow paths 156. Similar to the air-dissolved water that re-entered the diameter-increasing flow paths 156 through the first recirculation flow path 160, the fine bubbles in the air-dissolved water that re-entered the diameter-increasing flow paths 156 through the second recirculation flow path 162 are also refined to a greater extent.

Further, at the second direction-side end of the inner casing 150, the air-dissolved water that reaches the portions where the openings 188 (see FIG. 12) are defined flows through the openings 188 and flows out from the cylindrical portion 172. Then, the air-dissolved water that flowed out from the cylindrical portion 172 flows into a third discharging flow path OP3 defined between the outer circumferential wall 172*a* of the cylindrical portion 172 and the inner circumferential wall 100*c* of the main body casing 100.

As shown in FIG. 4, the air-dissolved water that flowed into the third discharging flow path OP3 collides with the second direction-side surfaces of the circumferential walls 182*a* of the second water receivers 182. By the air-dissolved water colliding with the circumferential walls 182*a*, the fine bubbles in the air-dissolved water break up and are refined into finer bubbles, and the volume of the fine bubbles increases. Then, the air-dissolved water flows along the second direction-side surfaces of the second water receivers 182 from the second direction side to the first direction side, and collides with second direction-side surfaces of the circumferential walls 180*a* of the first water receivers 180. By the air-dissolved water colliding with the circumferential walls 180*a*, the fine bubbles in the air-dissolved water break up and are refined into finer bubbles, and the volume of the fine bubbles increases. The air-dissolved water that collided with the first water receivers 180 flows along the second direction-side surfaces of the first water receivers 180 from the first direction side to the second direction side, and collides with first direction-side surfaces of the circumferential walls 182*a* of the second water receivers 182. By the air-dissolved water colliding with the circumferential walls 182*a*, the fine bubbles in the air-dissolved water break up and are refined into finer bubbles, and the volume of the fine bubbles increases. The air-dissolved water that collided with the circumferential walls 182*a* begin to flow from the second direction side to the first direction side, flows out from the second direction-side fine bubble generation portion 110 and enters into the first direction-side fine bubble generation portion 110.

As above, the air-dissolved water flows out from the fine bubble generation portion 110 after having flowed through the first discharging flow path OP1, the second discharging flow path OP2, and the third discharging flow path OP3. Hereinbelow, the first discharging flow path OP1, the second discharging flow path OP2, and the third discharging flow path OP3 may collectively be termed "discharging flow path". Then, a part of the air-dissolved water flowing in the discharging flow path re-enters the diameter-increasing flow paths 156 by the first recirculation flow path 160 and the second recirculation flow path 162 connecting the midstream of the discharging flow path and the first direction-side ends of the constant diameter flow paths 140. By the air-dissolved water re-entering the diameter-increasing flow paths 156, the fine bubbles in the air-dissolved water are further refined, and the fine bubbles are generated in large volume.

As above, the air-dissolved water flows through a total of two fine bubble generation portions 110. Due to this, the fine bubbles in the air-dissolved water are refined, and the fine bubbles are generated in large volume.

According to the above configuration, as shown in FIG. 3, the fine bubble generator 46 comprises the inlet 102 into which the air-dissolved water flows, the outlet 104 out of which the air-dissolved water flows, and the fine bubble generation portions 110 disposed between the inlet 102 and the outlet 104. Each of the fine bubble generation portions 110 comprises the venturi portion including the diameter-reducing flow paths 138 of which flow path diameter reduces from upstream to downstream and the diameter-increasing flow paths 156 of which flow path diameter increases from upstream to downstream and disposed downstream of the diameter-reducing flow paths 138, the discharging flow path (that is, the first discharging flow path OP1, the second discharging flow path OP2, and the third discharging flow path OP3) disposed downstream of the venturi portion for discharging the air-dissolved water out of the fine bubble generation portion 110, and the first recirculation flow path 160 and the second recirculation flow path 162 connecting the midstream of the discharging flow path and the venturi portion. The air-dissolved water that flows into the fine bubble generator 46 flows into the diameter-reducing flow paths 138 in the venturi portion of the fine bubble generation portion 110. The flow speed of the air-dissolved water is increased by flowing through the diameter-reducing flow paths 138, as the result of which its pressure is reduced. The bubbles are generated by this pressure reduction of the air-dissolved water. Then, the pressure of the air-dissolved water is gradually increased by flowing through the diameter-increasing flow paths 156. When the pressure of the air-dissolved water is increased after the bubbles were generated by the pressure reduction, the bubbles included in the air-dissolved water break up into fine bubbles. Then, the air-dissolved water including the fine bubbles flow through the discharging flow path and flows out of the fine bubble generation portion 110. In the venturi portion, a negative pressure is generated by the air-dissolved water flowing in the venturi portion (venturi effect). Further, the first recirculation flow path 160 and second recirculation flow path 162 connect the midstream of the discharging flow path and the venturi portion. Due to this, a part of the air-dissolved water flowing in the discharging flow path is suctioned in to the first recirculation flow path 160 and the second recirculation flow path 162 due to the negative pressure generated in the venturi portion. Then, the air-dissolved water suctioned into the first recirculation flow path 160 and the second recirculation flow path 162 re-enters the venturi portion. Due to the air-dissolved water flowing through the venturi portion again, the fine bubbles in the air-dissolved water are refined into finer bubbles, and the volume of the fine bubbles increases. Thus, the fine bubbles can be generated in large volume.

Further, as shown in FIG. 3, the venturi portion further comprises the constant diameter flow paths 140 connecting the first direction-side ends of the diameter-reducing flow paths 138 (that is, their downstream ends) and second direction-side ends of the diameter-increasing flow paths 156 (that is, their upstream ends), wherein the flow path diameter of the constant diameter flow paths 140 is constant. The flow path diameter of the constant diameter flow paths 140 are equal to the flow path diameter of the first direction-side ends of the diameter-reducing flow paths 138 (that is, their downstream ends). The first recirculation flow path 160 and the second recirculation flow path 162 are connected to the vicinity of the first direction-side ends of the constant diameter flow paths 140 (that is, the vicinity of their downstream ends). In the venturi portion, the flow speed of the air-dissolved water becomes fastest in the vicinity of the first direction-side ends of the constant diameter flow paths 140. Due to this, the largest negative pressure is generated in the vicinity of the first direction-side ends of the constant diameter flow paths 140 (that is, their downstream ends). According to the above configuration, the first recirculation flow path 160 and the second recirculation flow path 162 are connected to the vicinity of the first direction-side ends of the constant diameter flow paths 140. Due to this, the volume of the air-dissolved water suctioned into the first recirculation flow path 160 and the second recirculation flow path 162 from the discharging flow path can be increased. Thus, the volume of the air-dissolved water re-entering the venturi portion increases, as the result of which the fine bubbles can be generated in larger volume.

In one or more embodiments, as shown in FIG. 3, the second flanges 152 that guide the air-dissolved water flowing in the discharging flow path to the second recirculation flow path 162 are disposed on the discharging flow path downstream of the portion where the second recirculation flow path 162 is connected. According to the above configuration, the air-dissolved water flowing in the discharging flow path can more easily be suctioned into the second recirculation flow path 162 by the second flanges 152. Due to this, the volume of the air-dissolved water suctioned into the second recirculation flow path 162 from the discharging flow path can be increased. Thus, the volume of the air-dissolved water re-entering the venturi portion increases, as the result of which the fine bubbles can be generated in larger volume.

Further, as shown in FIG. 3, each of the fine bubble generation portions 110 further comprises the bottom wall 170 facing the openings at the first direction-side ends of the diameter-increasing flow paths 156 (that is, their downstream ends) and onto which the water flowing out from the diameter-increasing flow paths 156 collides, and the cylindrical portion 172 extending from the bottom wall 170 to the venturi portion side (second direction side) and surrounding at least a part of the venturi portion. The discharging flow path comprises the first discharging flow path OP1 defined between the bottom wall 170 and the openings at the first direction-side ends of the diameter-increasing flow paths 156 (that is, their downstream ends) and the second discharging flow path OP2 being a flow path downstream of the first discharging flow path OP1 and defined between the venturi portion and the cylindrical portion 172. The second recirculation flow path 162 is connected to the midstream of the second discharging flow path OP2. According to the above configuration, the air-dissolved water that flowed out from the diameter-increasing flow paths 156 collides with the bottom wall 170. By the air-dissolved water colliding with the bottom wall 170, the fine bubbles in the air-dissolved water break up and are refined into finer bubbles, and the volume of the fine bubbles increases. Further, since the second recirculation flow path 162 is connected to the midstream of the second discharging flow path OP2 on the downstream side of the first discharging flow path OP1, the air-dissolved water suctioned into the second recirculation flow path 162 and re-entering the venturi portion can flow out from the diameter-increasing flow paths 156 and collide again with the bottom wall 170. Due to this, the fine bubbles in the air-dissolved water break up and are refined into even finer bubbles, and the volume of the fine bubbles further increases.

Further, in the above configuration, the air-dissolved water that flowed within the venturi portion in the first direction and flowed out from the venturi portion collides with the bottom wall 170, and thereafter begins to flow in the second discharging flow path OP2 defined between the cylindrical portion 172 and the venturi portion in the second direction opposite to the first direction. According to such a configuration, the length of each fine bubble generation portion 110 in the first direction can be shortened as compared to the configuration in which the fine bubble generation portions 110 do not comprise the cylindrical portions 172, and the size of the fine bubble generator 46 can be reduced.

(Corresponding Relationship)

The first recirculation flow path 160 and the second recirculation flow path 162 are examples of "recirculation flow path". The second flanges 152 are examples of "guide wall". The bottom wall 170 is an example of "collision wall". The cylindrical portion 172 is an example of "side wall".

Specific examples of the present disclosure have been described in detail, however, these are mere exemplary indications and thus do not limit the scope of the claims. The art described in the claims includes modifications and variations of the specific examples presented above.

(First Variant) The position where the fine bubble generator 46 is disposed is not limited to the first hot water supply passage 32*a*. The fine bubble generator 46 may be disposed on the water supply passage 30, the bathtub-filling passage 50, the reheating passage 60, the first bathtub circulation passage 62, and/or the second bathtub circulation passage 68.

(Second Variant) In the above hot water supply system 2, the fine bubbles are generated using the air contained in the water supplied from the water source 4 such as the public tap water system. In a variant, the hot water supply system 2 may include an air-dissolved water generation device that dissolves air taken in from outside into water. Further, the air-dissolved water generated by the air-dissolved water generation device may be supplied to the fine bubble generator 46. Further, in another variant, an air introduction passage for introducing air from outside may be disposed on the constant diameter flow paths 140 of the fine bubble generation portion 110. Further, gases such as carbon dioxide, hydrogen, and/or oxygen may be dissolved in water instead of the air.

(Third Variant) The fine bubble generator 46 may include one fine bubble generation portion 110 or may include three or more fine bubble generation portions 110.

(Fourth Variant) The position where the first recirculation flow path 160 and the second recirculation flow path 162 are connected to the venturi portion is not limited to the vicinity of the first direction-side ends of the constant diameter flow paths 140. For example, the first recirculation flow path 160 and the second recirculation flow path 162 may be connected to the diameter-reducing flow paths 138, to the constant diameter flow paths 140 on the upstream side of the vicinity of the first direction-side ends of the constant diameter flow paths 140, or to the diameter-increasing flow paths 156.

(Fifth Variant) The venturi portion may not include the constant diameter flow paths 140.

(Sixth Variant) The fine bubble generation portion 110 may not include the second flanges 152. That is, the "guide wall" may be omitted.

(Seventh Variant) The fine bubble generation portion(s) 110 may not include the bottom wall 170 and the cylindrical portion 172. That is, the "collision wall" and the "side wall" may be omitted. In the present variant, the air-dissolved water that flowed out from the venturi portion (more specifically, the diameter-increasing flow paths 156) flows in the first direction.

(Eighth Variant) The fine bubble generation portion(s) 110 may not include the cylindrical portion 172. That is, the "side wall" may be omitted. In the present variant, the air-dissolved water that flowed out from the venturi portion (more specifically, the diameter-increasing flow paths 156) collides with the bottom wall 170 and thereafter flows in the first direction. In the present variant, the second recirculation flow path 162 is preferably connected to the midstream of the discharging flow path downstream of the bottom wall 170 (that is, on the first direction side).

Technical features described in the description and the drawings may technically be useful alone or in various combinations, and are not limited to the combinations as originally claimed. Further, the art described in the description and the drawings may concurrently achieve a plurality of aims, and technical significance thereof resides in achieving any one of such aims.

What is claimed is:

1. A fine bubble generator comprising:

an inlet into which gas-dissolved water in which gas is dissolved flows;

an outlet out of which the gas-dissolved water flows; and a fine bubble generation portion disposed between the inlet and the outlet, wherein the fine bubble generation portion comprises:

a venturi portion including a diameter-reducing flow path, and a diameter-increasing flow path, wherein a flow path diameter of the diameter-reducing flow path reduces from upstream to downstream, and the flow path diameter of the diameter-increasing flow path increases from upstream to downstream;

a discharging flow path configured to discharge the gas-dissolved water, which flowed out of the venturi portion, out of the fine bubble generation portion; and a recirculation flow path connecting a midstream of the discharging flow path and the venturi portion, wherein a pump is not disposed in the recirculation flow path.

2. The fine bubble generator according to claim 1, wherein the venturi portion further comprises a constant diameter flow path connecting a downstream end of the diameter-reducing flow path and an upstream end of the diameter-increasing flow path, wherein the flow path diameter of the constant diameter flow path is constant, the flow path diameter of the constant diameter flow path is equal to the flow path diameter of the downstream end of the diameter-reducing flow path, and the recirculation flow path is connected to a vicinity of proximate to the downstream end of the constant diameter flow path.

3. The fine bubble generator according to claim 1, wherein the discharging flow path comprises a guide wall disposed downstream of a connection where the recirculation path is connected to the discharging flow path, the guide wall being configured to guide the gas-dissolved water flowing in the discharging flow path to the recirculation flow path.

4. A fine bubble generator comprising:

an inlet into which gas-dissolved water in which gas is dissolved flows;

an outlet out of which the gas-dissolved water flows; and a fine bubble generation portion disposed between the inlet and the outlet, wherein the fine bubble generation portion comprises:

a venturi portion including a diameter-reducing flow path, and a diameter-increasing flow path, wherein a flow path diameter of the diameter-reducing flow path reduces from upstream to downstream, and the flow path diameter of the diameter-increasing flow path increases from upstream to downstream;

a discharging flow path configured to discharge the gas-dissolved water, which flowed out of the venturi portion, out of the fine bubble generation portion; and a recirculation flow path connecting a midstream of the discharging flow path and the venturi portion, wherein the fine bubble generator further comprises:

a collision wall facing an opening of a downstream end of the diameter-increasing flow path, wherein the gas-dissolved water flowing out of the diameter-increasing flow path collides with the collision wall; and a side wall extending from the collision wall to a venturi portion side and surrounding at least a part of the venturi portion, wherein the discharging flow path includes:

a first discharging flow path defined between the collision wall and the opening of the downstream end of the diameter-increasing flow path; and a second discharging flow path disposed downstream of the first discharging flow path and defined between the venturi portion and the side wall, and the recirculation flow path is connected to a midstream of the second discharging flow path.

5. A fine bubble generator comprising:

an inlet into which gas-dissolved water in which gas is dissolved flows;

an outlet out of which the gas-dissolved water flows; and a fine bubble generation portion disposed between the inlet and the outlet, wherein the fine bubble generation portion comprises:

a venturi portion including a diameter-reducing flow path and a diameter-increasing flow path, wherein a flow path diameter of the diameter-reducing flow path reduces from upstream to downstream, and the flow path diameter of the diameter-increasing flow path increases from upstream to downstream;

a discharging flow path configured to discharge the gas-dissolved water, which flowed out of the venturi portion, out of the fine bubble generation portion; and a recirculation flow path connecting a midstream of the discharging flow path and the venturi portion, wherein the venturi portion further comprises a constant diameter flow path connecting a downstream end of the diameter-reducing flow path and an upstream end of the diameter-increasing flow path, wherein a flow path diameter of the constant diameter flow path is constant, the flow path diameter of the constant diameter flow path is equal to the flow path diameter of the downstream end of the diameter-reducing flow path, and the recirculation flow path is connected proximate to the downstream end of the constant diameter flow path, wherein the discharging flow path comprises a guide wall disposed downstream of a connection where the recirculation path is connected to the discharging flow path, the guide wall being configured to guide the gas-dissolved water flowing in the discharging flow path to the recirculation flow path, wherein the fine bubble generator further comprises:

a collision wall facing an opening of a downstream end of the diameter-increasing flow path, wherein the gas-dissolved water flowing out of the diameter-increasing flow path collides with the collision wall; and a side wall extending from the collision wall to a venturi portion side and surrounding at least a part of the venturi portion, wherein the discharging flow path includes:

a first discharging flow path defined between the collision wall and the opening of the downstream end of the diameter-increasing flow path; and a second discharging flow path disposed downstream of the first discharging flow path and defined between the venturi portion and the side wall, and the recirculation flow path is connected to a midstream of the second discharging flow path.

* * * * *